US005398484A

United States Patent [19]

Kader

[11] Patent Number: 5,398,484

[45] Date of Patent: Mar. 21, 1995

[54] TRANSFER DEVICE FOR GRIPPING AND DEPOSITING A FILLED BAG AND FOR MOVING IT INTO A CLOSING DEVICE

[75] Inventor: Karl-Wilhelm Kader, Hennef, Germany

[73] Assignee: Chronos Richardson GmbH, Hennef, Germany

[21] Appl. No.: 30,779

[22] Filed: Mar. 12, 1993

[30] Foreign Application Priority Data

Mar. 13, 1992 [DE] Germany ..... 9203380 U

[51] Int. Cl.[6] ..... B65B 7/06; B65B 1/00

[52] U.S. Cl. ..... 53/481; 53/284.7; 53/374.5; 198/463.2; 198/463.3

[58] Field of Search ..... 53/284.7, 138.3, 373.2, 53/374.3, 374.5, 374.6, 375.6, 373.7, 374.2, 481, 469; 198/463.2, 463.3

[56] References Cited

U.S. PATENT DOCUMENTS

| | | | |
|---|---|---|---|
| 2,049,757 | 8/1936 | Baker et al. | 53/284.7 X |
| 2,721,018 | 10/1955 | Heavin | 53/284.7 |
| 2,911,778 | 11/1959 | Ozor | 53/375.6 |
| 2,926,474 | 3/1960 | Morrison et al. | 53/374.6 |
| 3,990,216 | 11/1976 | Martin | 53/375.6 X |

*Primary Examiner*—Horace M. Culver
*Attorney, Agent, or Firm*—Francis N. Carten

[57] ABSTRACT

A transfer device for gripping a filled bag from a suspended position at a filling neck and depositing the bag on a conveyor belt for moving it into a bag closing device, a clamping assembly having two approximately vertical arms which are articulated at their lower ends, with horizontal clamping strips attached thereto, with the arms, for the purpose of clamping in the upper end of the bag by means of the clamping strips below the bag clamps at the filling neck, being movable at their free ends in the sense of closing the clamping strips and with the arms being able to accommodate the conveyor belt extending between them in the direction of the opening edge of the bag; a linear drive unit for moving the clamping assembly in the direction of the conveyor belt; and a lifting unit for the clamping assembly, for depositing the bag clamped in between the clamping strips on the conveyor belt, with the actuating means for the clamping assembly, the drive unit and the lifting unit being arranged below the conveyor belt.

15 Claims, 9 Drawing Sheets

FIG. 10
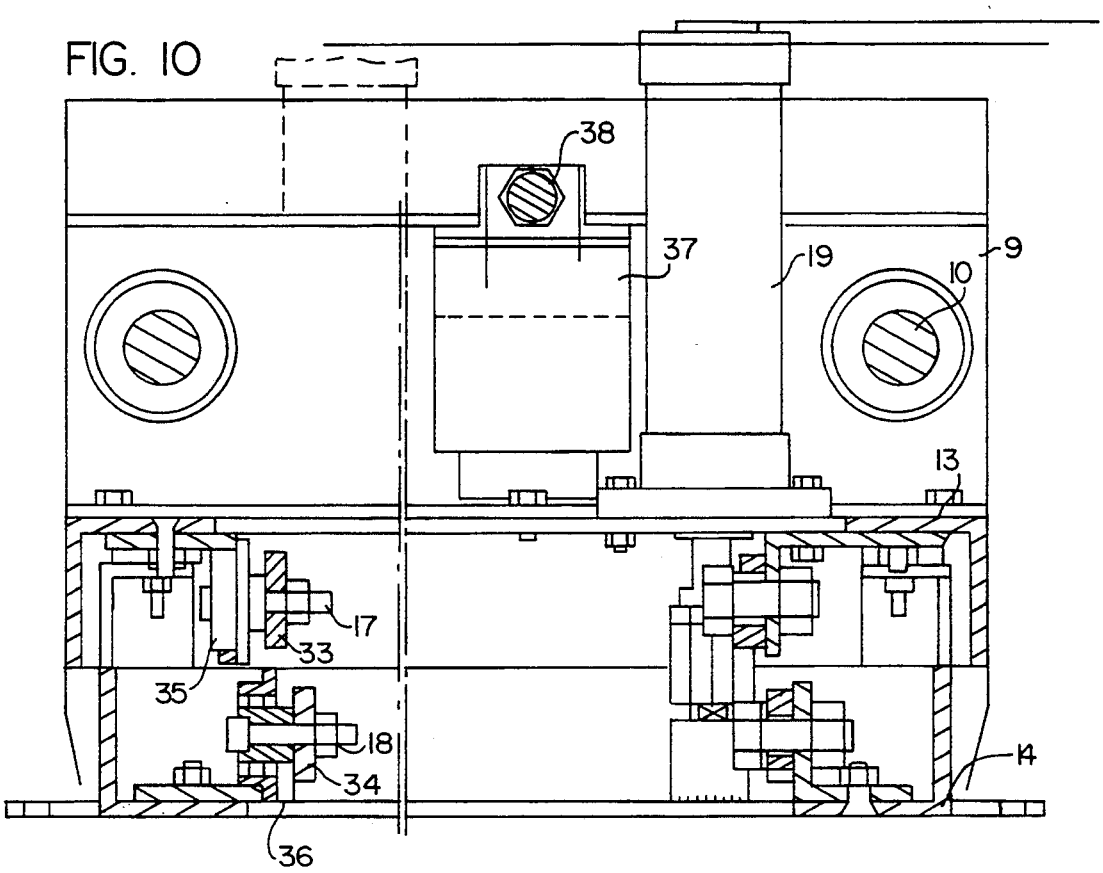
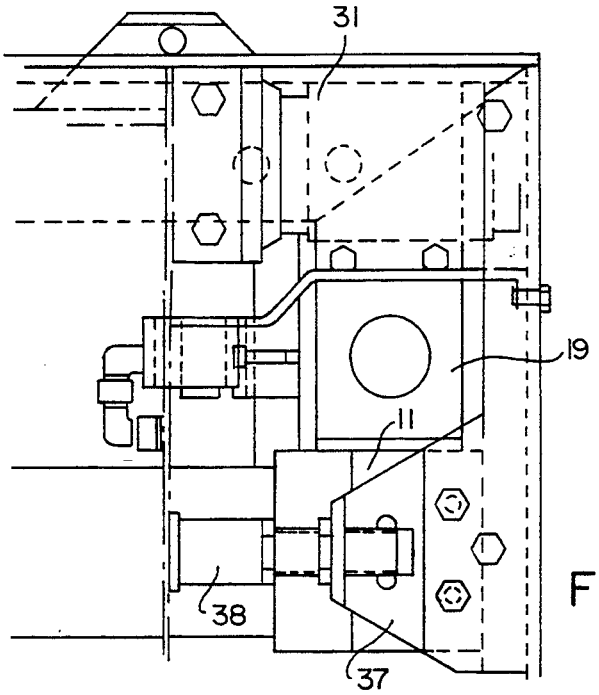
FIG. 11

TRANSFER DEVICE FOR GRIPPING AND DEPOSITING A FILLED BAG AND FOR MOVING IT INTO A CLOSING DEVICE

BACKGROUND OF THE INVENTION

The invention relates to a transfer device for gripping a filled bag being held in a suspended position at a filling neck, depositing the bag on a conveyor belt, and, in synchronization with the conveyor belt, moving the bag into a bag closing device. Bags filled and held in a suspended position at a filling neck are normally deposited on a conveyor belt passing through underneath the filling neck by releasing the bag clips at the filling neck, or they are held by grips and deposited on the conveyor belt and then released. The bag opening is then expanded by expanding devices engaging the opening from above. Subsequently, the bags with their upper ends being expanded by the expanding devices above the product level are transferred to a closing device.

During the period between releasing the bags by the bag clips at the filling neck and completing the expanding operation by the expanding devices, the bags are at least partially out of control. This may lead to the bags being deposited on the conveyor belt at an angle, and being expanded and closed in a way not corresponding to their side folds. Bags filled with a highly aerated product may even fall over after having been released onto the conveyor belt. This applies both to flat bags and to bags with side folds; in the latter case, the side folds may open up in the region of the bag opening.

SUMMARY OF THE INVENTION

The present invention is embodied in and carried out by a transfer device by means of which bags suspended at the filling neck (especially bags already expanded in that position) are transferred to the bag closing device while being under maximum control. This novel transfer device comprises: a clamping assembly having two approximately vertical arms which are articulated at their lower ends, with horizontal clamping strips attached thereto, with the arms, for the purpose of clamping the upper end of the bag by means of the clamping strips below the bag clamps at the filling neck, being movable at their free ends to close the clamping strips against the bag near its open end, the arms being positioned on opposite sides of the conveyor belt which extends between them in the direction of the edges of the open end of the bag; a linear drive unit for moving the clamping assembly in the direction of the conveyor belt; and a lifting unit for the clamping assembly and linear drive unit, for depositing the bag on the conveyor belt while still held between the clamping strips, with the actuating member for the clamping assembly, the linear drive unit and the lifting unit all being positioned below the conveyor belt. In this way, it is possible to grip and close the bag opening even before it is released by the clips arranged at the filling neck and to move the bag into the bag closing device in a fully closed condition, and, for bags with side folds, without the side folds opening up. A further advantage of the present invention over the prior art is its ability to transfer bags of different heights from the filling equipment to the closing device without dropping the bag onto the conveyor belt and without having to adjust the position of the conveyor belt. Furthermore, by designing the clamping strips to have an appropriate length, it is possible to handle bags with differently sized openings. The transfer device embodying the present invention is also designed to be simple and operationally safe.

The present invention is advantageously employed in combination with the bag clamping device disclosed and claimed in co-pending U.S. patent application Ser. No. 07/990,643 entitled BAG CLAMPING DEVICE filed on Dec. 14, 1992 by the present inventor and assigned to Chronos Richardson GmbH, and the disclosure of said application is incorporated herein by reference.

DESCRIPTION OF THE DRAWINGS

The written description of the present invention will be more fully understood when read with reference to the accompanying drawings, of which:

FIG. 10 shows combined sectional views of the lifting unit and the linear drive unit for the clamping assembly, taken along the section lines 5—5 and 6—6 shown in FIG. 9.

FIG. 11 shows a partial top view of the lifting unit and the linear drive unit for the clamping assembly of the transfer device shown in FIGS. 1, 2, 9 and 10.

DETAILED DESCRIPTION OF THE PREFERRED EMBODIMENT

The best mode of carrying out the invention is shown in detail in the aforementioned drawing figures and is described hereunder. Corresponding parts have been given identical reference numbers. The clamping assembly has been given the reference number 100, the linear drive assembly the reference number 200 and the lifting unit the reference number 300.

Figure 1:
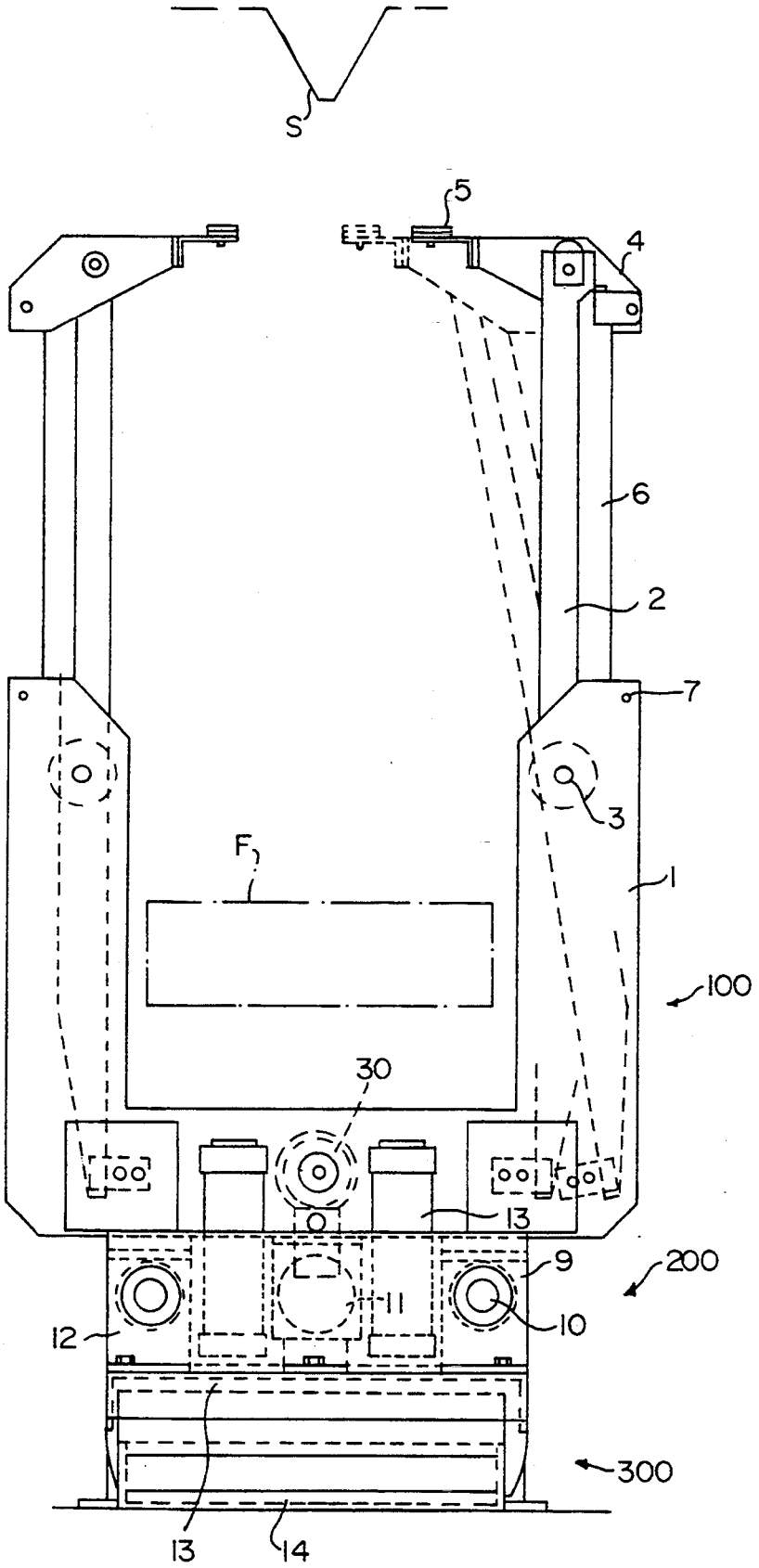
FIG. 1 shows an end view of the transfer device, looking in the direction of travel of the upper surface of the conveyor belt.

FIG. 1 shows a substantially U-shaped holding member 1 in which vertical arms 2 are pivotally mounted for rotation around first rotational axes through pins 3. Head pieces 4 are pivotally mounted at the upper ends of vertical arms 2, with clamping strips 5 being attached to said head pieces 4. The substantially unchanged vertical position of the head pieces 4 during the pivot movement of the levers 2 is accomplished by steering levers 6, which are supported in rotational axes through pins 7 in holding member 1 and rotational axes through pins 23 in the head pieces 4. As indicated diagrammatically, the lower ends of the vertical arms 2 are connected to one another via a coupling linkage 30 for simultaneous actuation. A conveyor belt F, indicated by broken lines, is positioned between the vertical arms 2 and within the U-shaped holding member 1. Directly above said conveyor belt, a filling neck S is positioned. Below the U-shaped holding member 1, there are located guiding elements 9 which are movable on rails 10 extending longitudinally and parallel to the conveyor belt F. A driving cylinder 11 is provided in a central position for the linear drive 200.

Figure 2:
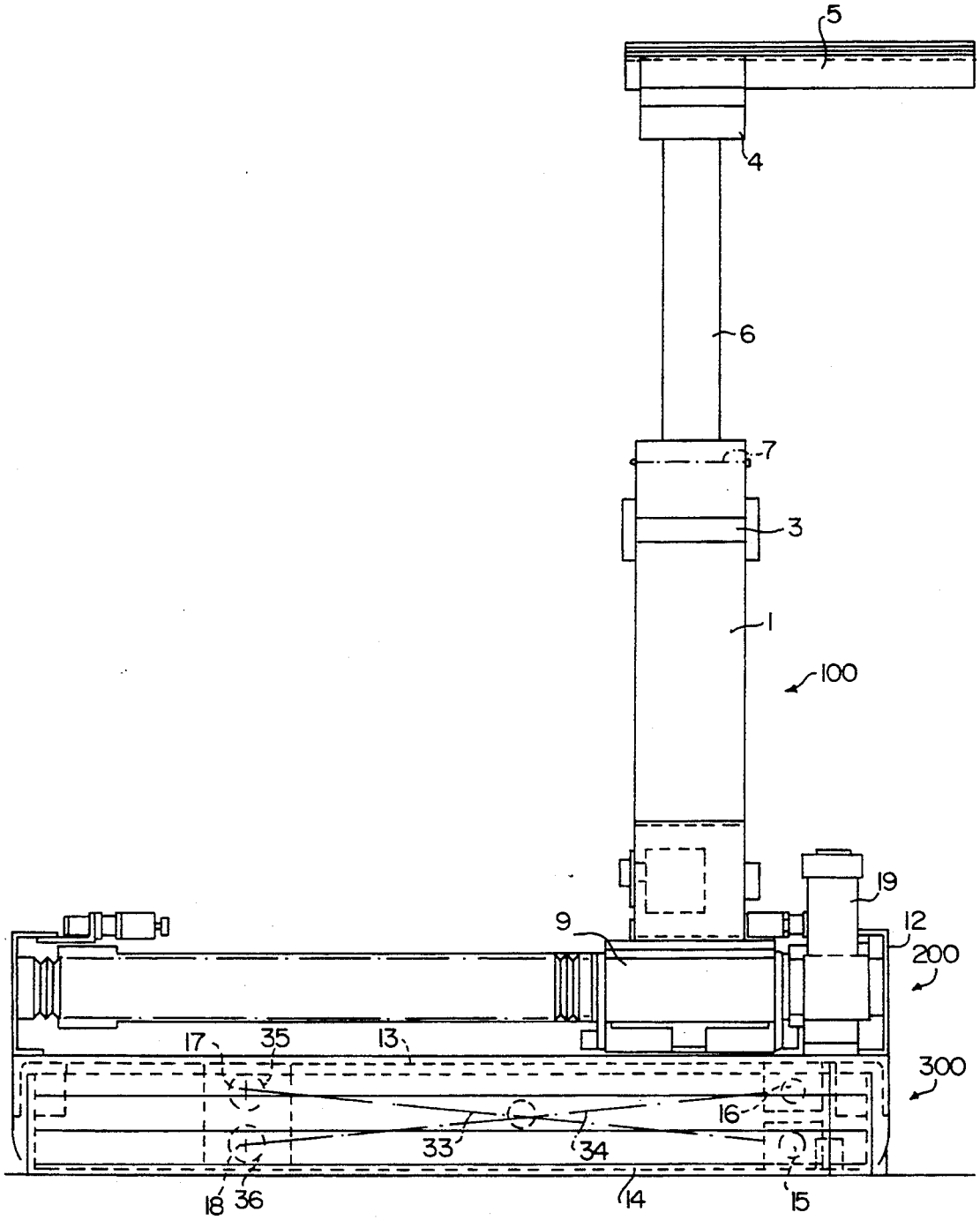
FIG. 2 is a side elevation of the transfer device according to FIG. 1.

FIG. 2 shows that the ends of the rails 10 of linear drive assembly 200 are positioned on a lifting unit 300 via connecting pieces 12. The lifting unit 300 is essentially a scissors lift, comprising an upper plate 13, a lower plate 14 and intersecting scissor levers 33, 34 which are supported by axes through pins 15, 16 in these plates and which, at their other ends, are supported on the plates via rollers 35, 36 supported by axes through pins 17, 18 in the levers 33, 34. Lifting cylinders 19 are located on the upper plate 13, and, when actuated, the plates 13 and 14 are moved vertically away from one another while remaining parallel to one another.

Figure 3:
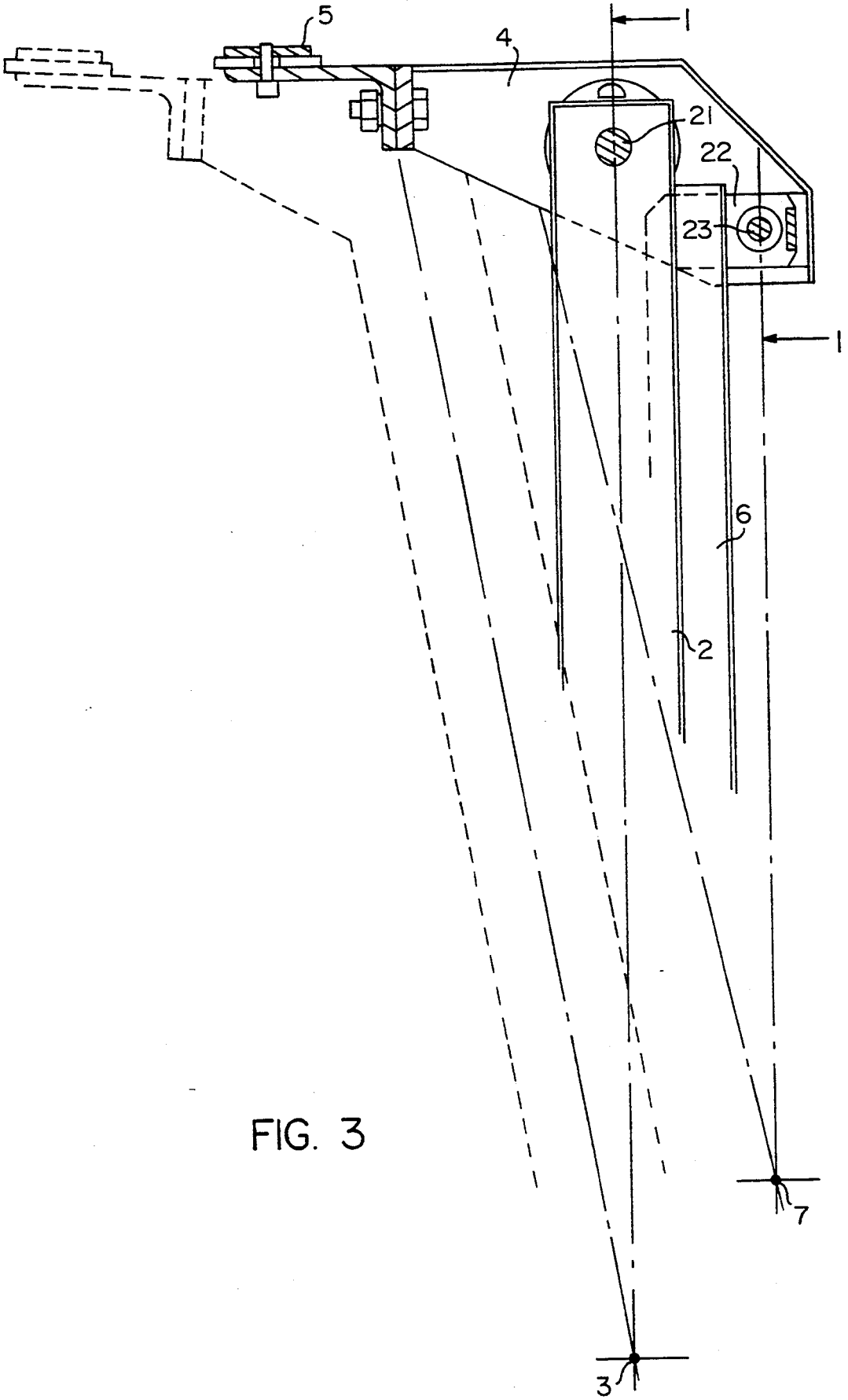
FIG. 3 shows a partial section of the upper end of one of the arms of the transfer device shown in FIGS. 1 and 2.
Figure 4:
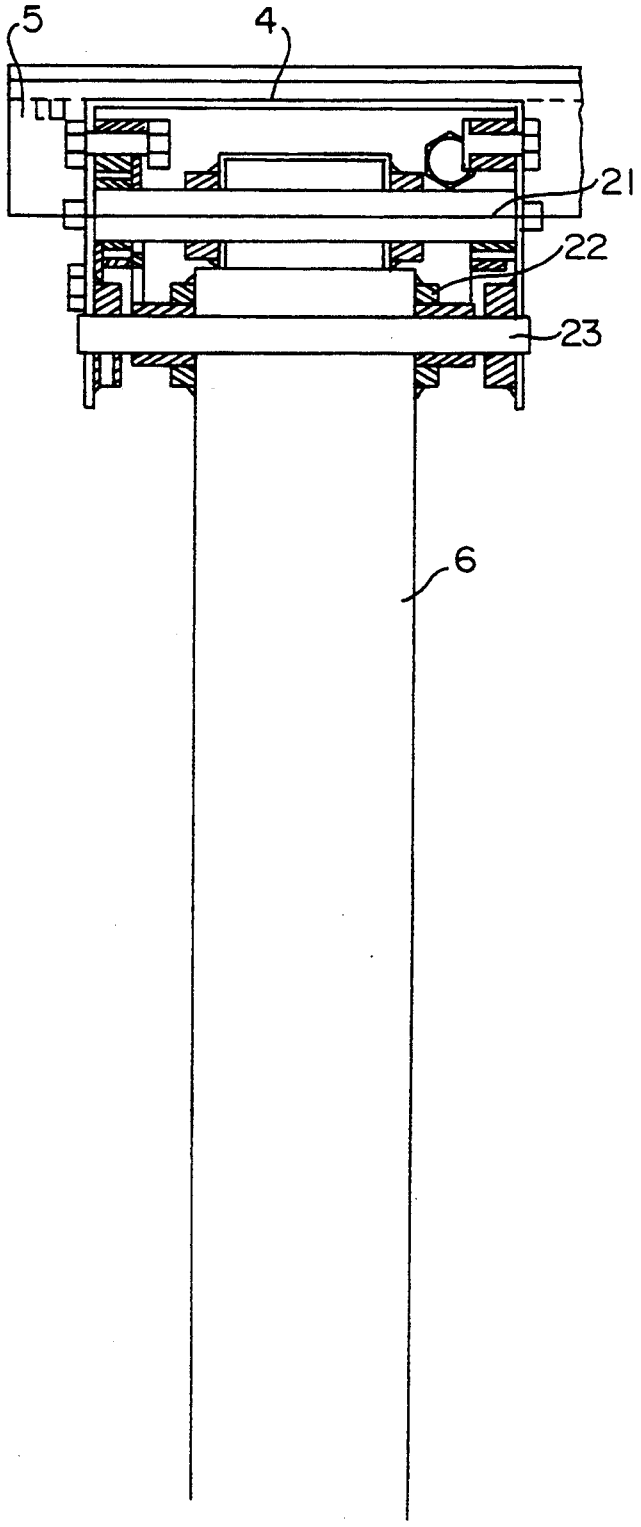
FIG. 4 shows a sectional view of the upper end of one of the arms of the transfer device shown in FIGS. 1 and 2, taken along the section lines I—I shown in FIG. 3.
Figure 5:
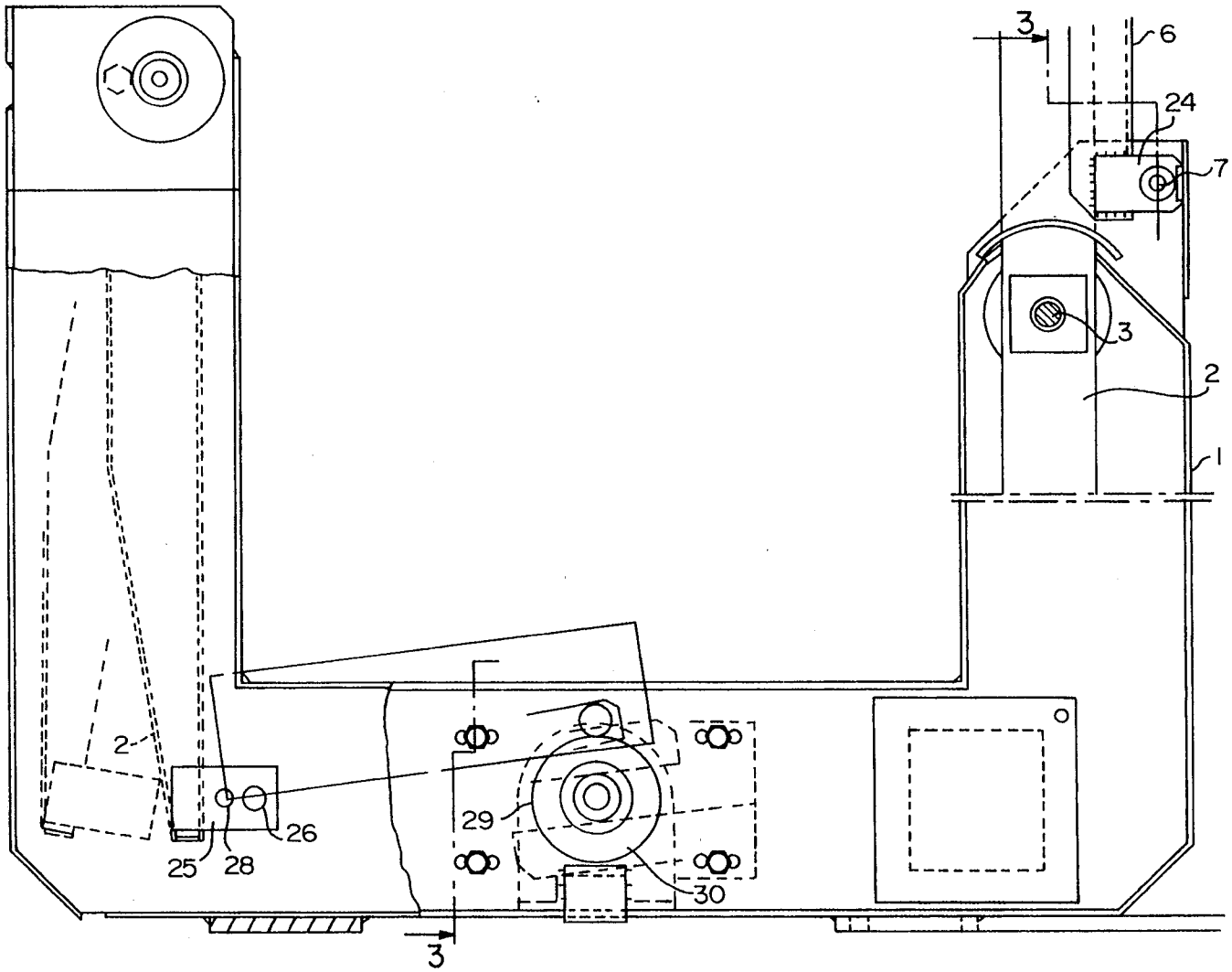
FIG. 5 shows an end view of the U-shaped holding member and actuating assembly for the vertical arms of the transfer device shown in FIGS. 1, 2, 3 and 4, including a partial sectional view along the section lines 2—2 in FIG. 7.
Figure 6:
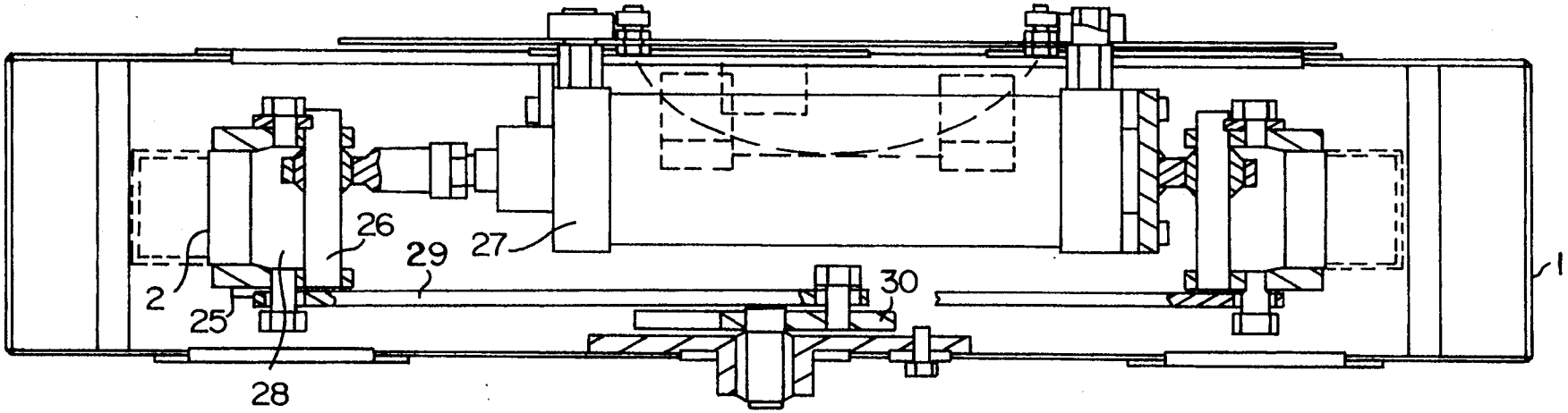
FIG. 6 shows a partially-sectional bottom view of the holding member and actuating assembly shown in FIG. 5.
Figure 8:
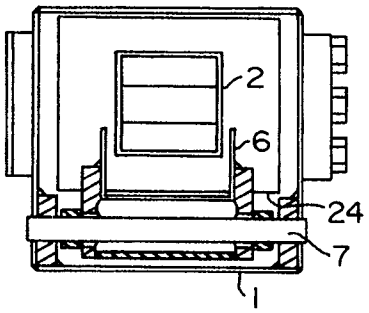
FIG. 8 shows a sectional top view of the pivotal connection of the steering lever to the holding member shown in FIGS. 5 and 7, taken along the section line 4—4 shown in FIG. 7.
Figure 7:
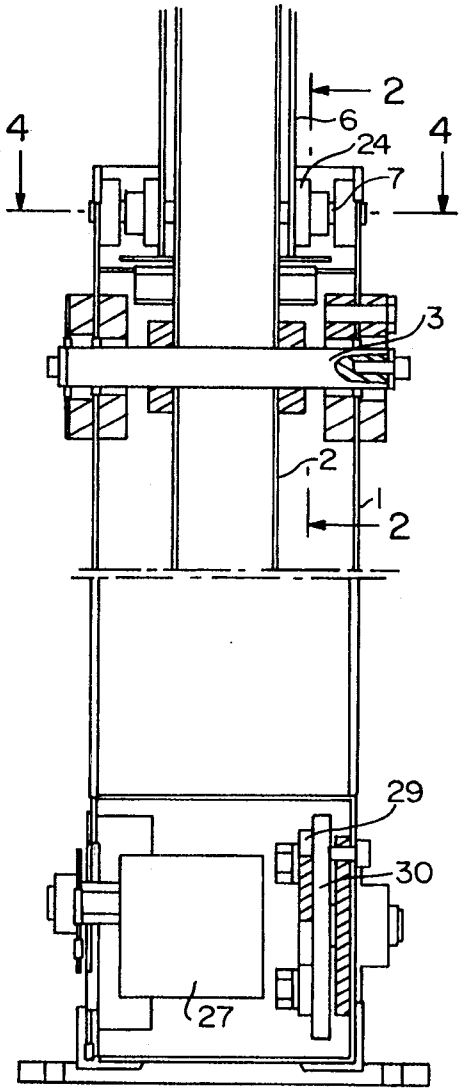
FIG. 7 shows a partially-sectional side view of the holding member and actuating assembly shown in FIG. 5, taken along the section lines 3—3 shown in FIG. 5.

FIG. 3 shows the axes through pins 3 and 7 supported in the frame 1 and constituting the fulcra for the arms 2 and the steering lever 6. The rotational axis through pin 21 for the head piece 4 is attached at the upper end of the arm 2. Furthermore, the steering arm 3 is provided with holding devices 22 holding a rotational axis through pin 23 to permit parallel control of the head piece 4, as also shown in FIG. 4. The multi-component clamping strip 5 is attached to the head piece. The substantially horizontal movement of the clamping strip during the pivot movement of the levers 2 is indicated by broken lines. During the operation of closing the levers 2 and clamping strips 5, it is thus possible to prevent any tensile forces from affecting the bag surface by preventing vertical movement of the clamping strips 5.

FIGS. 5, 6, 7 and 8 show several sections of the U-shaped holding member 1, which has a generally rectangular cross-section. The right-hand arm of the holding member is illustrated in a shortened form so that again it is possible to see the axes through pins 3 and 7 for the arm 2 and the steering lever 6 which is provided with connecting pieces 24. The lower end of the left-hand arm of the holding member is shown to have been provided with connecting pieces 25. The first axis through pin 26 of the arms is acted upon by an actuating cylinder 27. On the second axes through pins 28, there are supported steering levers 29 which move synchronously via a rotatable coupling member 30.

Figure 9:
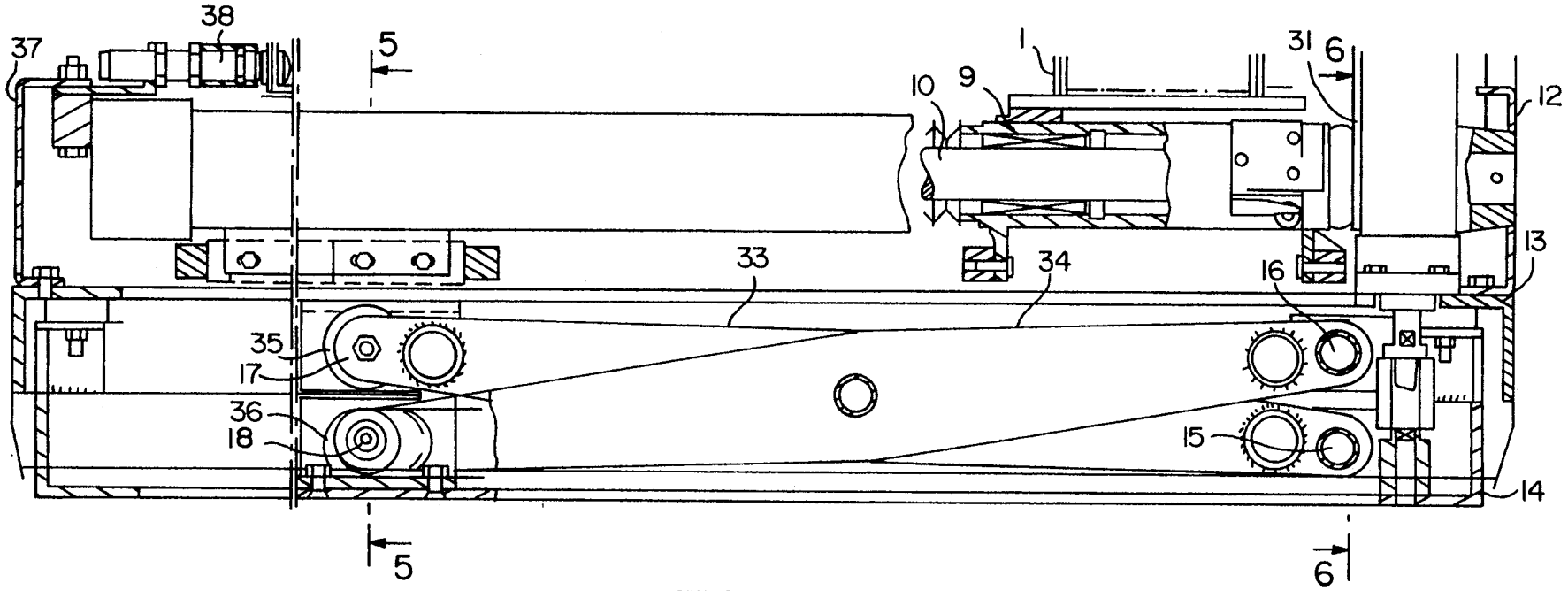
FIG. 9 shows a partially-sectional side view of the lifting unit and the linear drive unit for the clamping assembly of the transfer device shown in FIGS. 1 and 2.

In FIG. 9, the connection of the lower or horizontal part of the U-shaped holding member 1 to one of the guiding elements 9 is shown, both guiding elements 9 being axially movable along rails 10. On both sides of the guiding elements 9, the rails 10 are protected by adjustable shock absorbers 31. The holding members 12 at the ends of the rails 10 are fitted on the upper plate 13 of the lifting unit which also shows its lower plate 14 and the scissor levers 33, 34 provided in pairs. The scissor levers 33, 34 are supported at one end in the axes through pins 15, 16 and, at their other ends, comprise rollers 35, 36 supported in axes through pins 17, 18. The actuating cylinders 19 shown in FIGS. 9, 10 and 11 cause the plate 13 to be lifted or lowered relative to the plate 14, with the scissor levers 33, 34 ensuring that the parallel arrangement of the plates 13, 14 will be maintained. Central holding member 37 has adjustable end stops 38 for the U-shaped holding member 1. The driving cylinder 11 for the linear drive 200 is positioned between the rails 10 and below the level of holding member 1. In operation, the transfer device begins a cycle with the lifting unit 300 extended vertically to reach a filled bag suspended from filling neck S, and with the clamping assembly 100 positioned at one end of its path of travel on the linear drive assembly 200 so as to be positioned under the suspended bag. The clamping assembly 100 is actuated and clamps the upper end of the filled bag by the closing of the clamps 5, and the linear drive assembly 200 is actuated upon the release of the bag by the filling neck bag clips. Simultaneously, the lifting unit 300 is actuated and lowers the bag toward the conveyor belt F. The speed with which the linear drive assembly 200 transports the bag is, at the time the bag is lowered onto the conveyor belt F, substantially the same as the speed of the conveyor belt F, and remains so until the bag is released by the clamping assembly 100 after the bag is under the control of a bag closing device. Then, after release of the bag by the opening of the clamps 5 of the clamping assembly 100, the linear drive assembly 200 returns the clamping assembly 100 to its initial position and, simultaneously, the lifting unit 300 raises both the clamping assembly 100 and the linear drive assembly 200 to reach another filled bag suspended from filling neck S. The cycle is thus completed, and the transfer device is prepared to repeat the cycle. It should be noted that, throughout the operational cycle of the transfer device, the filled bag has its open end clamped shut, thereby preventing both spillage and dust from escaping into the work environment.

In the embodiment described above, the novel sequencing of events in the operation of the applicant's novel transfer device for gripping and depositing a filled bag from a suspended position at a filling neck on a conveyor belt and for moving it into a bag closing device is effected by known technology, which determines whether a particular step in the novel sequence of steps carried out by the transfer device has been completed and which step(s) should be performed next in the sequence. In order not to unduly complicate the drawings and thereby obscure the invention, such conventional elements as electrical power and air pressure sources, timers, sensors and their connections and related circuitry have not been shown.

Certain modifications and variations of the disclosed embodiment of the present invention will be apparent to those skilled in the art. It should be understood that the disclosed embodiment is intended to be illustrative only, and not in any way restrictive of the scope of the invention as defined by the claims set forth hereunder.

I claim:

1. A transfer device for gripping a filled bag having an open end with at least one pair of opposed edges being held in a suspended position at a filling neck having bag clamps for holding the open end of the bag while it is being filled, depositing the bag onto a conveyor belt, and, in synchronization with the conveyor belt, moving the bag into a bag closing device, said transfer device comprising:

(a) a clamping assembly having two approximately vertical arms each having a free upper end and a lower end, with horizontal clamping strips attached to said upper ends of said arms for the purpose of clamping the open end of the bag below the bag clamps of the filling neck, said arms being synchronously rotatable by actuating means connected to their lower ends so as to move their free upper ends toward or away from each other to close or open, respectively, said clamping strips, and with said arms being spaced apart so as to have the conveyor belt extending between them in the direction of the opposed edges of the open end of the bag;

(b) a linear drive unit for moving said clamping assembly over the conveyor belt in the direction of the opposed edges of the open end of the bag; and (c) a lifting unit for said clamping assembly and said linear drive unit, for depositing the bag clamped in between said clamping strips onto the conveyor belt and, in synchronization with the conveyor belt, moving the bag into a bag closing device, with said actuating means for said clamping assembly, said linear drive unit and said lifting unit being positioned below the conveyor belt.

2. The transfer device according to claim 1, wherein said arms comprise head pieces which are rotatably attached to their free ends and which carry said clamping strips, with said head pieces, during the pivoting movement of the arms, being guided substantially horizontally via steering levers arranged parallel to said arms.

3. The transfer device according to claim 2, wherein said clamping assembly includes a U-shaped holding member on which said arms are pivotally mounted, the lower ends of said arms being acted upon by an actuating cylinder connected thereto, with a synchronizing linkage connecting the lower ends of said arms.

4. The transfer device according to any one of claims 1 to 3, wherein said lifting device comprises a lower plate, an upper plate and intermediate double scissors levers each having opposed ends, each pair of which, at their one ends, are rotatably supported in one of the plates and which, via rollers attached to their other ends, are supported on the other plate, and lifting cylinders operating perpendicularly between said plates.

5. The transfer device according to claim 4, wherein said linear drive unit comprises two horizontal rails firmly attached to said upper plate, and holding means for the clamping assembly so as to be movable in the direction of travel of the conveyor belt.

6. A transfer device for gripping a filled bag being held in a suspended position at a filling neck having bag clamps for holding the bag while it is being filled, depositing the filled bag onto a conveyor belt, and, in synchronization with the conveyor belt, moving the filled bag into a bag closing device, said transfer device comprising:

(a) clamping means operative to clamp the upper end of the filled bag below the bag clamps at the filling neck;

(b) linear drive means operative to move said clamping means horizontally and parallel to the conveyor belt; and (c) lifting means operative to move said clamping means and said linear drive means vertically so as to deposit the filled bag onto the conveyor belt and, in synchronization with the conveyor belt, to move the filled bag into a bag closing device.

7. The transfer device according to claim 6, wherein said clamping means comprises:

(a) a holding member;

(b) two opposed vertical arms rotatably mounted on said holding member, each having a free upper end and a lower end and a clamping strip at its free upper end;

(c) actuating means connecting the lower ends of said vertical arms.

8. The transfer device according to claim 7, wherein said holding member is substantially U-shaped and at least partially underlies the conveyor belt.

9. The transfer device according to claim 7 or 8, wherein said clamping means further comprises head pieces rotatably attached to the free ends of said vertical arms and which carry said clamping strips, said head pieces being rotatably connected by steering levers to said holding member so as to be guided substantially horizontally during the pivoting movement of said vertical arms.

10. The transfer device according to claim 7 or 8, wherein said actuating means comprises an actuating cylinder connecting the lower ends of said vertical arms.

11. The transfer device according to claim 10, wherein said actuating means further comprises synchronizing linkage connecting the lower ends of said arms.

12. The transfer device according to claim 6, wherein said linear drive means comprises a pair of rails on which guiding means are moved horizontally by a driving cylinder, said clamping means being supported by said guiding means.

13. The transfer device according to claim 12, wherein said linear drive means further comprises limit means for restricting the extent of the horizontal travel of said guiding means.

14. The transfer device according to claim 6, wherein said lifting means comprises a powered scissors lift for moving said clamping means and said linear drive means vertically.

15. A method of closing a filled bag by clamping means and moving it from a suspended position at a filling neck onto a conveyor belt and for moving it into a bag closing device, comprising the steps of:

(a) clamping the upper end of the filled bag in its suspended position at the filling neck by the clamping means;

(b) moving the filled bag from its suspended position at the filling neck, with its upper end clamped by the clamping means which move down with the filled bag, onto a conveyor belt positioned thereunder;

(c) in synchronization with the conveyor belt, moving the filled bag clamped by the clamping means into a bag closing device; and (d) unclamping the filled bag.

* * * * *